United States Patent [19]

Bebbington et al.

[11] Patent Number: 4,706,859

[45] Date of Patent: Nov. 17, 1987

[54] CLOTHESPIN HOLDER

[76] Inventors: John R. W. Bebbington; Julie C. Bebbington, both of 6 Parkway, Whitwell, Worksop, Nottinghamshire S80 4TR, United Kingdom

[21] Appl. No.: 814,734

[22] Filed: Dec. 30, 1985

[30] Foreign Application Priority Data

Jan. 31, 1985 [GB] United Kingdom ..... 8502504

[51] Int. Cl.[4] ..... A45F 3/00

[52] U.S. Cl. ..... 224/224; 224/202; 224/151

[58] Field of Search ..... 224/202, 203, 257, 258, 224/901, 224, 225, 226, 151, 267, 272; D32/35, 36

[56] References Cited

U.S. PATENT DOCUMENTS

| | | | |
|---|---|---|---|
| 43,539 | 7/1864 | Weston | 224/203 |
| D. 135,538 | 4/1943 | Kaplan | D32/36 |
| D. 158,442 | 5/1950 | Christopher et al. | D32/36 |
| 243,363 | 6/1881 | Crouch | 224/224 |
| 629,908 | 8/1899 | McClean | 224/203 X |
| 1,352,453 | 9/1920 | Jennings | 224/224 |
| 2,513,971 | 7/1950 | Skinner | 224/151 X |
| 2,551,991 | 5/1951 | Armstrong et al. | 224/267 X |
| 2,580,913 | 1/1952 | Hawthorne | 224/920 X |
| 2,739,746 | 3/1956 | Hayes et al. | 224/203 |
| 2,782,553 | 2/1957 | Harris | 224/224 X |
| 2,996,227 | 8/1961 | Andrew | 224/224 X |
| 3,346,152 | 10/1967 | Geisendorff | 224/224 |
| 3,931,917 | 1/1976 | Zellmer | 224/203 |

*Primary Examiner*—Henry J. Recla
*Assistant Examiner*—Robert M. Petrik
*Attorney, Agent, or Firm*—Young & Thompson

[57] ABSTRACT

A sash-like holder for clothespins comprises parallel strips joined together at spaced intervals along their lengths by stiffeners or gussets and optionally also by a web which gives the holder a trough-like configuration. The strip intended to be worn next to the body is longer than the outer strip by terminal portions which can be fastened together at chosen positions to form a loop of the right size for the user. As well as being shorter the outer strip is less wide than the inner strip and the top or free edge of the outer strip is arranged for the mounting thereon of a row of clothespins. In use the inner strip is made into a loop of convenient size and is passed over one shoulder so that it rests against the opposite side of the body. A row of clothespins mounted on the edge of the outer strip is thus at hand even when reaching up to a clothes line and the number of pins remaining available is immediately visible. The "sash" can be rotated around the body to gain access to pins previously out of reach.

10 Claims, 4 Drawing Figures

CLOTHESPIN HOLDER

BACKGROUND OF THE INVENTION

When hanging laundry to dry on a clothes line the use of clothes pins is complicated by the fact that both hands are occupied much of the time and when only one is needed, e.g. to hold an item ready to be pegged, movement is severely limited and it is difficult or impossible to reach any distance for a pin. This makes a basket or similar container for the pins, which generally must rest on the ground, impractical to use as one cannot stoop to it while reaching up to the line and there is the additional inconvenience of having to remember to move it to keep pace with one's own movements along the clothes line.

People adopt many expedients to try to ensure that a pin is within reach when required, such as stuffing pins into pockets or even holding them in the mouth. The latter measure is unsatisfactory for obvious reasons which are exacerbated by changes in the form taken by clothes pins. The traditional wooden pin has been largely superseded by a bifurcated plastics item with a metal spring part and this is uncomfortable as well as unhygienic to place in the mouth. Pockets are generally unsuitably shaped and positioned and there is a risk of damage to the clothing. Perhaps the optimum solution currently known is to keep pins in the pocket of an apron, although aprons are less commonly used than they were and few now on the market have a pocket. Even this expedient, however, is not ideal as one must remember to refill the pocket and its capacity is limited. Using one hand to hold an item of clothing on the line one may grope into the pocket only to find that there are no pins left.

The only previously published document of relevance known to the Applicants at the time of filing this Application is U.S. Pat. No. 3,931,917 (Zellmer) granted on Jan. 13th 1976. This has come to the Applicants' attention by being the sole document listed in the search report of the British Patent Office on their copending British Patent Application No. 8502504. The personal materials carrier of Zellmer is a band worn like a sash and having a number of pockets at least some of which open diagonally upwardly and at first sight would be suitable, or could be modified to be suitable, for the purposes of the present invention. However there is no awareness in the Zellmer specification of the particular problems encountered in the use of clothes pins as outlined above and the pockets of Zellmer serve an entirely different purpose. In the case of the personal materials carrier there is no attempt to space any part of the band from the body or clothing of the user since instant accessability to something "pegged" onto the outer edge of a pocket is not envisaged except in the case of a single, transverse pocket 15 which opens upwardly and is specially located. Although not so stated it is positively undesireable that the diagonal pockets should be too open or accessable in case their contents fall out or are too easily stolen, so that it does not matter if the pockets "collapse" over their contents or if their openings are obstructed e.g. by the folds of the garmet over which the band is worn. The series of pockets is interrupted by plain band portions 4 and 6 and it is not envisaged that the band should be rotated around the body to gain access to different pockets. If it were, "unpegged" items would tend to fall out.

SUMMARY OF THE INVENTION

An object of the present invention is to provide a holder specifically designed to facilitate the use of clothes pins and, in a simple and economical manner, to provide a holder whereby clothes pins are presently individually at the right location. Another object is to provide that the greater part of the length of the loop, including the part passing behind the user, can be used for clothes pins storage and yet the holder can be manipulated with one hand so as to bring clothes pins within reach as they are used. Another and important object of the invention is to provide means whereby clothes pins mounted on the holder are held away from the body or clothing of the user so that e.g. folds of the latter will not interfere with access to the pins. Another object of the invention is to provide a holder which displays the pins so that the number remaining available can be seen at a glance. Another object of the invention is to provide a holder which will protect the clothing of the user from being soiled by the clothes pins.

In accordance with one aspect of the invention these objects are achieved by the provision of a holder for clothes pins comprising a first, flat, elongated member capable of forming a loop to be placed on one shoulder of the user so as to rest against the opposite side of the body, a second, flat, elongated member dimensioned for the mounting thereon of a row of clothespins in side-by-side relation and means for maintaining the second member in a relation generally parallel to but spaced from the first member such that in use of the holder the second member is held away from the body or clothing of the user to facilitate access to clothes pins mounted on the second member.

Said means for maintaining the second member in spaced relation to the first member preferably comprises a plurality of gusset means between the members at spaced intervals along the lengths of the members and transverse thereto. The width of the second member is preferably less than that of the first member. Opposite end portions of the first member may be provided with releasable attachment means whereby the first member may be formed into a loop. The said releasable attachment means are preferably provided on terminal portions of the first member and the second member is preferably shorter than the first member by the extent of said terminal portions. The said attachment means preferably permits the formation of a loop of different dimensions to suit different users. The said means for maintaining the second member in spaced relation to the first member may comprise web means extending between the members longitudinally thereof whereby the holder is generally U-shaped in cross section.

In accordance with another aspect of the present invention there is provided a holder for clothes pins comprising a first, flat, elongated member of flexible material which can be looped and worn in the manner of a sash on one shoulder to pass diagonally across the body and rest against the opposite side of the body in the hip region, a second, flat, elongated member of flexible material and a plurality of spacer means extending transversely of said first and second members in mutually spaced relation, the second member having a thickness such that clothes pins may be mounted side-by-side thereon and said spacer means serving, in use of the holder, to maintain clothes pins on the second member away from the body or clothing of the user.

The transverse width of the first member is preferably greater than that of the second member and one longitudinal edge of the second member is preferably inset relative to the nearer longitudinal edge of the first member such that in use of the holder portions of the pins mounted on said one edge of the second member which protrude from the space between the members will rest against the area of the first member exposed from the second member.

In accordance with yet another aspect of the present invention there is provided a clothes pin holder which comprises a first, flat, elongated member of flexible material which can be worn in the manner of a sash over one shoulder to extend diagonally across the front and back of the body and rest against the opposite side of the body in the hip region, terminal end portions of said first member, attachment means on said terminal end portions whereby they may be releasably connected in overlapping relation in different positions selected by the user, a second, flat, elongated member of flexible material coextensive with said first member between said terminal end portions of the latter, said second member being narrower in transverse width than said first member and having one lateral edge inset relative to the nearer lateral edge of said first member and means for maintaining the first and second members in mutually spaced relation throughout the length of the second member, said means comprising gussets transverse to said members and in spaced relation along the length of the second member and a generally flat web portion which extends between and longitudinally of said members so that the holder, between said terminal end portions of the first member, is generally of flat-bottomed, U-shaped cross section.

BRIEF DESCRIPTION OF THE DRAWINGS

By way of non-limitative example one embodiment of the invention is illustrated in the accompanying drawings. In the drawings.

DETAILED DESCRIPTION OF THE DRAWINGS

Figure 1:
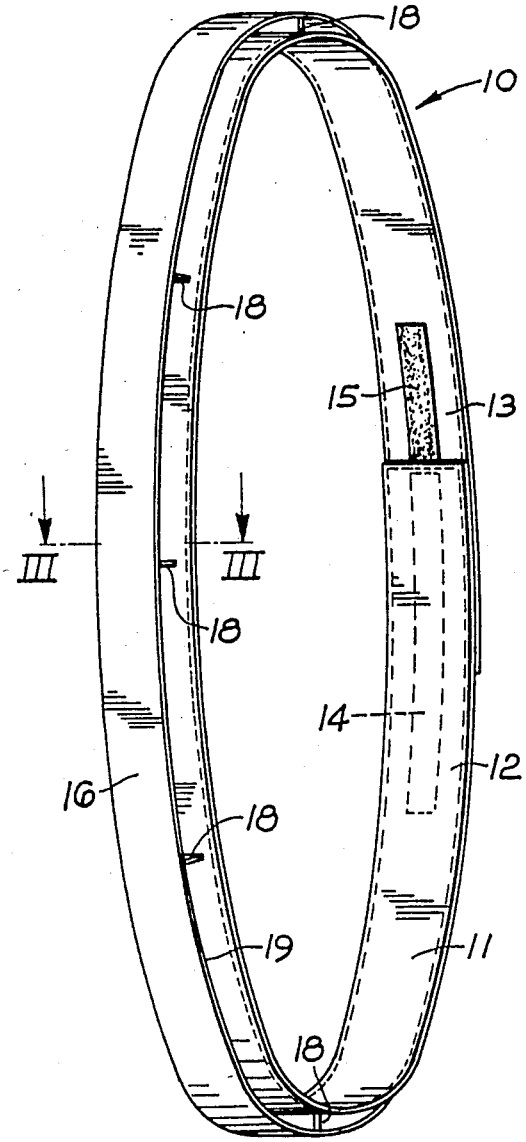
FIG. 1 and FIG. 2 are respectively a front and a rear perspective view of a clothes pin holder in accordance with the invention.
Figure 2:
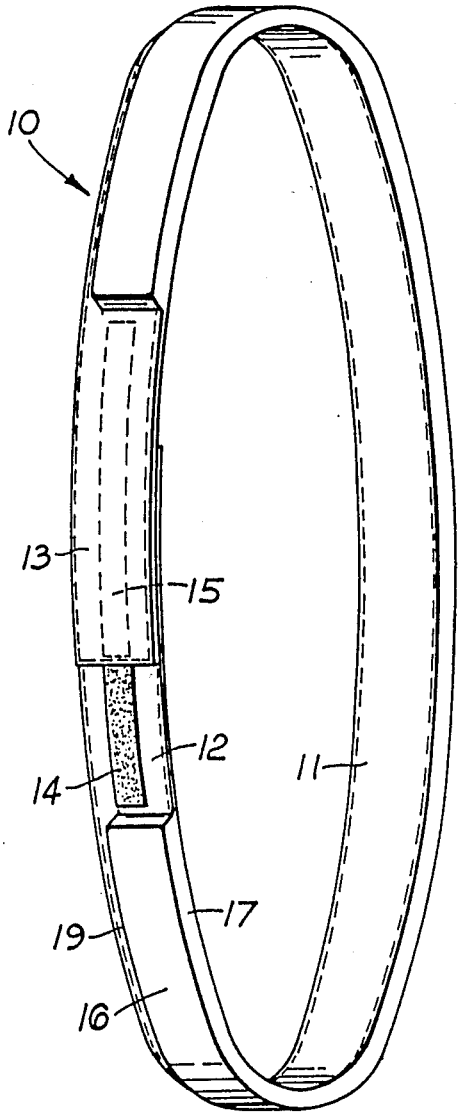
Figure 3:
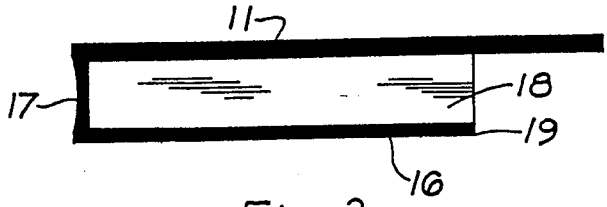
FIG. 3 is a cross-sectional view taken on the line III—III of FIG. 1.
Figure 4:
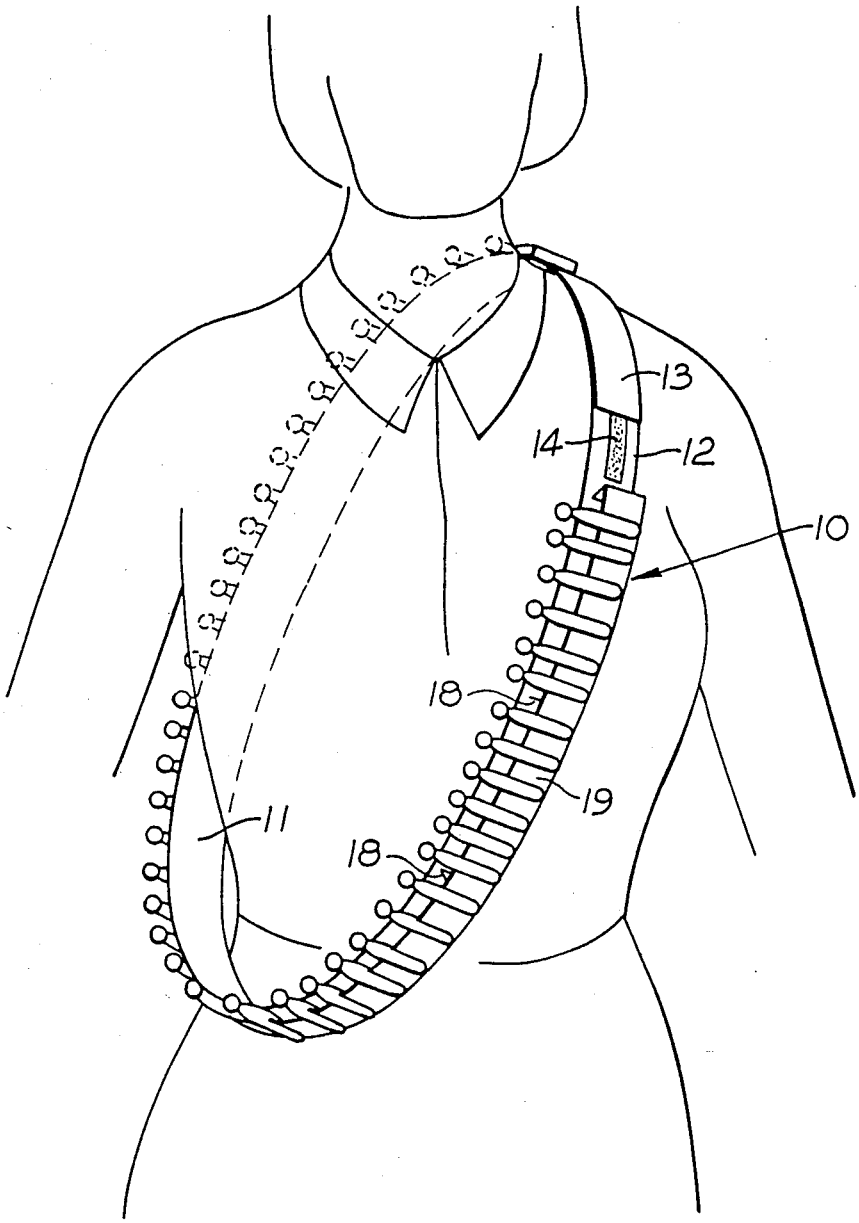
FIG. 4 is a view of the device in use.

The clothes pin holder 10 illustrated comprises a first, elongated flat strip 11 of flexible material which may be straightened out but which is shown with terminal portions 12 and 13 joined together to form a loop. This is intended to be worn like a sash over one shoulder with the opposite end of the loop resting against the waist or hip region of the opposite side of the user's body. To enable the length of the loop to be altered to suit the height of the user the terminal portions 12 and 13 may be joined at different positions. By way of example they have on their facing sides integral strips 14 and 15 of a self-adherent material such as strips of VELCRO-type hook and eye fastener to allow infinite adjustment but it will be clear that any known suitable means may be provided for effecting the releasable attachment of the terminal portions 12 and 13 at different, selected positions such as one of the adjustable buckles provided for trouser belts.

Parallel with the first strip 11 is a second strip 16 of less width and which stops short of the terminal portions 12 and 13 of the first strip. A base or web 17 joins the strips 11 and 16 along one of their respective edges, and the effect is that the narrower strip 16 forms the lower wall of a channel. The channel is kept open—or in other words the two strips 11 and 16 are held in spaced relation—not only by the base 17 but by stiffeners or gussets 18 which extend between the two strips 11 and 16 at spaced intervals along their lengths.

In use of the holer 10 it is made into a loop of a size suitable for the wearer and passed over the head to rest on one shoulder with the narrower strip 16 presented outwardly. Either before it is put on or afterwards clothes pins (not shown) are mounted over the free edge 19 of the lower, outer wall 16 of the channel, gripping the said wall 16 in a row. As, of course, there are no pins where there is no strip 16 it is convenient to position the joined end portions 12 and 13 either on the shoulder or behind the body, but the sash-like loop is easily fed circularly round the body, while worn, to gain access to different parts of the loop so that, using one hand only, the user can rotate the loop round the body to bring more pins within reach.

When mounted on the strip 16 the pins are ideally positioned to be grasped by one hand while the other is, for example, reaching upward to a clothes line. Right-handed people will tend to prefer to wear the loop on the left shoulder so that pins can be reached by the right hand, and vice-versa.

The holder can act as a storage device for the clothes pins when not in use, being coiled into a tight spiral to occupy the minimum of space. In use it presents the pins to the user individually, like the rounds of ammunition in a bandolier, from the most convenient position and the use of the holder provides the added advantage that one can see at a glance how many clothes pins are available from it.

The materials used for the construction of the holder and its manner of manufacture are capable of great diversity. A plastics material such as polyurethane is probably the most pratical material from which to form the strips 11 and 16, having the necessary stiffness yet flexibility and being considerably cheaper than leather. It is envisaged that the strips 11 and 16 and the base 17 may be integral, the gussets being inserted into the fixed in slots (not shown) in the opposed sides of the strips. The gussets may be made integral with the walls 11 and 16, and if desired with the base or web 17, by fusion bonding or by means of an adhesive. Alternatively the holder 10 may be a moulded item.

Provision of the base or web portion 17 is optional. It may be preferred to omit it or to provide apertures in it so that, e.g. long-legged pins (of a kind now rather unusual) may be mounted on the strip 16. An advantage of the "trough" configuration, however, is that a dislodged pin is less likely to fall to the ground.

We claim:

1. A holder for clothespins comprising a first, flat, elongated member having a length adopted to form a loop to be placed on one shoulder of the user and wrap around and rest against the opposite side of the body, terminal end portions of said first member, attachment means on said terminal end portions whereby they may be releasably connected in overlapping relation in different positions selected by the user, a second, flat, elongated member coextensive with said first member and extending at least most of the distance between said terminal end portions of the latter, said second member being dimensioned for the mounting therealong of a row on clothespins in side-by-side relation and means for maintaining the second member in a relation generally parallel to but spaced from the first member such that in use of the holder the second member is held away from the clothing of the user to facilitate access to clothespins mounted along the second member.

2. A holder as claimed in claim 1, wherein said means for maintaining the second member is spaced relation to the first member comprises a plurality of gusset means between the members at spaced intervals along the lengths of the members and transverse thereto.

3. A holder as claimed in claim 1, wherein the width of the second member is less than that of the first member.

4. A holder as claimed in claim 1, wherein opposite end portions of the first member are provided with releasable attachment means whereby the first member may be formed into a loop.

5. A holder as claimed in claim 4, wherein said releasable attachment means are provided on terminal portions of the first member and the second member is shorter than the first member by the extent of said terminal portions.

6. A holder as claimed in claim 5, wherein said attachment means permit the formation of a loop of different dimensions to suit different users.

7. A holder as claimed in claim 1, wherein said means for maintaining the second member in spaced relation to the first member comprises web means extending between the members longitudinally thereof whereby the holder is generally U-shaped in cross section.

8. A holder for clothespins comprising a first, flat, elongated member of flexible material having a length which can be looped and worn in the maner of a loose sash on one shoulder to pass diagonally across the body and rests against the opposite side of the body in the hip region, a second, flat, elongated member of flexible material extending at least most of the length of the first member, and a plurality of spacer means extending transversely of said first and second members in mutually spaced relation, the second member having a width and thickness such that colthespins may be firmly mounted side-by-side therealong and said spacer means serving, in use of the holder, to maintain the length of the second member in generally parallel to but spaced relation to the first member such that clothespins on the second member are held away from the clothing of the user, the dimensions of the loose sash being such that in use of the holder it may be rotated relative to the body of the user to gain access to clothespins at different positions along said second member.

9. A holder as claimed in claim 8, wherein the transverse width of the first member is greater than that of the second member and one longitudinal edge of the second member is inset relative to the nearer longitudinal edge of the first member such that in use of the holder portions of pegs mounted on said one edge of the second member which protrude from the space between the members will rest against the area of the first member exposed from the second member.

10. A holder for clothespins comprising a first, flat, elongated member of flexible material which having a first which can be worn in the manner of a loose sash over one shoulder to extend diagonally across the front and back of the body and rest against the opposite side of the body in the hip region, terminal end portions on said first member, attachment means on said terminal end portions whereby they may be releasably connected in overlapping relation in different positions of adjustment selected by the user, a second, flat, elongated member of flexible material coextensive with said first member at least most of the distance between said terminal end portions of the latter, said second member being narrower in transverse width than said first member and having one lateral edge inset relative to the nearer lateral edge of said first member and stiffener means for maintaining the first and second members in mutually spaced relation along the length of the second member and a generally flat web portion which extends between and longitudinally of said members so that the holder, between said terminal end portions of the first member, is generally of flat-bottomed, U-shaped cross section the dimensions of said members being such that in use of the holder it may be rotated relative to the body of the user to gain access to clothespins at different positions alng the U-shaped cross-sectional portion of the length of the holder.

* * * * *